US009573265B2

(12) United States Patent
Li

(10) Patent No.: US 9,573,265 B2
(45) Date of Patent: Feb. 21, 2017

(54) ARM HOLDER FOR A POLE-HANDLED TOOL

(71) Applicant: Zhihong Li, Chandler, AZ (US)

(72) Inventor: Zhihong Li, Chandler, AZ (US)

( * ) Notice: Subject to any disclaimer, the term of this patent is extended or adjusted under 35 U.S.C. 154(b) by 117 days.

(21) Appl. No.: 14/568,107

(22) Filed: Dec. 11, 2014

(65) Prior Publication Data

US 2016/0167215 A1 Jun. 16, 2016

(51) Int. Cl.
*B25G 1/00* (2006.01)

(52) U.S. Cl.
CPC ..... *B25G 1/00* (2013.01); *Y10T 16/4713* (2015.01)

(58) Field of Classification Search
CPC ... A01B 1/026; B25D 17/046; Y10T 16/4696; Y10T 16/4713; Y10T 16/476; B25G 1/00; B25G 1/06; B25G 1/10; B25G 1/102; B25G 3/00; B25G 3/34; B25G 3/36; B25G 3/24; B25G 3/12; B25G 3/26
USPC ..... 15/410, 411, 22.1, 143.1, 144.1, 144.2,15/145, 146, 229.6, 244.2, 257.7
See application file for complete search history.

(56) References Cited

U.S. PATENT DOCUMENTS 1,083,054 A * 12/1913 Brown ..... B25G 1/00 15/246
1,151,012 A * 8/1915 Herringstad ..... B25G 1/00 294/58
1,534,075 A * 4/1925 Parrish ..... A01B 1/026 16/426
2,482,589 A * 9/1949 Maguire ..... B25G 1/102 15/143.1
2,614,879 A * 10/1952 Citso ..... A01B 1/026 294/58
4,229,033 A * 10/1980 Vosbikian ..... A01B 1/026 16/426
4,704,758 A * 11/1987 Hoffman ..... B25G 1/04 15/143.1
4,780,992 A * 11/1988 McKervey ..... A47L 11/145 15/1.7
4,958,407 A * 9/1990 Johnson ..... A01B 1/22 15/144.1
4,985,961 A * 1/1991 Kegley ..... B25G 1/04 15/144.3
4,993,766 A * 2/1991 Sutherland ..... B25J 1/04 294/104
5,133,101 A * 7/1992 Hauser ..... A47L 13/24 15/143.1
5,156,429 A * 10/1992 Adams ..... B25F 5/021 16/422
5,275,068 A * 1/1994 Wrench ..... A01B 1/22 30/296.1
5,331,720 A * 7/1994 Beckingham ..... A01B 1/00 15/144.4

(Continued)

*Primary Examiner* — Jeffrey O Brien
(74) *Attorney, Agent, or Firm* — Morgan Law Offices, PLC

(57) ABSTRACT

The disclosure relates to an arm holder for a pole-handled tool such as a broom, a mop, a squeegee, etc. that allows effective use of the pole-handled tool with only one hand. The arm holder comprises an arm grip having an arm-holding structure; and an attachment portion capable of attaching the arm grip to the pole-handled tool; wherein the arm-holding structure is capable of receiving an arm positioned within the arm-holding structure while a corresponding hand of the same arm grasps the pole handle, the pole handle acting as a lever where the corresponding hand forms a fulcrum of the lever.

12 Claims, 4 Drawing Sheets

(56) References Cited

U.S. PATENT DOCUMENTS 5,379,758 A * 1/1995 Snyder ..... A61B 17/02 15/143.1
5,411,305 A * 5/1995 Revoldt ..... A01B 1/026 294/54.5
5,471,698 A * 12/1995 Francis ..... A47L 13/08 15/144.1
5,499,852 A * 3/1996 Seigendall ..... A01B 1/026 294/54.5
5,529,357 A * 6/1996 Hoffman ..... A01B 1/026 15/145
5,695,231 A * 12/1997 Hoffman ..... A01B 1/026 16/426
5,890,259 A * 4/1999 Sarac ..... A01B 1/00 16/422
6,062,619 A * 5/2000 Clark, Jr. ..... A01B 1/026 16/426
6,154,918 A * 12/2000 Cain ..... A47L 5/24 15/327.5
6,370,991 B1 * 4/2002 Hsieh ..... B25B 7/00 81/177.9
6,435,284 B1 * 8/2002 Aman ..... A01B 1/00 172/371
6,464,272 B1 * 10/2002 Michaud ..... A01B 1/026 16/430
D484,023 S * 12/2003 Stout ..... D8/107
6,662,399 B1 * 12/2003 Vairo ..... A47L 1/16 15/111
6,704,968 B2 * 3/2004 Lau ..... A01B 1/026 16/426
6,820,628 B2 * 11/2004 Larson ..... A01B 1/02 135/66
6,931,690 B2 * 8/2005 Cox ..... A47L 1/06 15/144.1
7,014,232 B2 * 3/2006 Bosa ..... A01B 1/026 16/426
7,093,667 B2 * 8/2006 Hurt ..... A01B 1/06 172/381
7,657,972 B2 * 2/2010 Jenkins ..... B25G 1/06 16/106
7,818,847 B1 * 10/2010 Hermann ..... B25G 1/00 16/110.1
7,882,596 B2 * 2/2011 Hixon ..... A01B 1/026 16/406
8,082,619 B1 * 12/2011 Willey ..... A46B 5/02 15/143.1
8,671,523 B1 * 3/2014 Day ..... A45F 5/10 16/422
8,973,200 B2 * 3/2015 Mallett ..... A46B 5/00 15/143.1
9,149,925 B1 * 10/2015 Van Valin ..... B25G 1/102
2006/0174449 A1 * 8/2006 Hughes ..... A61F 4/00 16/430
2010/0005607 A1 * 1/2010 DelaBarre ..... A46B 5/02 15/143.1
2010/0037424 A1 * 2/2010 Swerdlick ..... A47L 9/325 15/410
2010/0299855 A1 * 12/2010 Megeath ..... A46B 5/025 15/22.1
2011/0049920 A1 * 3/2011 Guerra ..... A01B 1/026 294/58
2011/0099765 A1 * 5/2011 Youssefieh ..... A01D 7/00 16/430
2012/0048074 A1 * 3/2012 Mosher ..... B25G 1/06 81/489
2012/0144964 A1 * 6/2012 Lee ..... B25G 1/102 81/489
2012/0234129 A1 * 9/2012 Adan ..... B62J 23/00 74/551.8
2012/0324676 A1 * 12/2012 Guerra ..... A01B 1/026 16/426
2014/0132015 A1 * 5/2014 Stachowski ..... A01B 1/026 294/51
2014/0196232 A1 * 7/2014 Guido ..... A46B 5/002 15/143.1
2014/0304949 A1 * 10/2014 Denton ..... B25G 1/102 16/430
2015/0007862 A1 * 1/2015 Dickerson, II ..... A45B 7/005 135/72
2015/0367499 A1 * 12/2015 Arketa Zabala ..... A47L 13/46 15/143.1
2016/0001437 A1 * 1/2016 Frascello ..... B25G 1/06 16/421

* cited by examiner

ARM HOLDER FOR A POLE-HANDLED TOOL

BACKGROUND OF THE INVENTION

1. Field of the Invention

The present invention relates to an arm holder for a pole-handled tool.

2. Description of the Related Art

Using a tool such as a broom or a mop with a pole handle typically constrains the user to use both hands to hold the tool. However, often it would be advantageous to have one hand free to do something else while using the tool. For example, it would be desirable to use a broom to sweep while moving furniture and other objects out of the way or to hold a dustpan to sweep debris into the dustpan with the broom. Accordingly, there is a need for a device to allow effective use of a pole-handled tool with only one hand.

SUMMARY OF THE INVENTION

The disclosure relates to an arm holder for a pole-handled tool such as a broom, a mop, a squeegee, etc. that allows effective use of the pole-handled tool with only one hand. The arm holder comprises an arm grip having an arm-holding structure; and an attachment portion capable of attaching the arm grip to the pole-handled tool; wherein the arm-holding structure is capable of receiving an arm positioned within the arm-holding structure while a corresponding hand of the same arm grasps the pole handle, the pole handle acting as a lever where the corresponding hand forms a fulcrum of the lever.

In an embodiment, the attachment portion includes a hole disposed on an end of the arm-holding structure that accommodates the pole handle extended through the hole along the pole handle. In another embodiment the attachment portion includes an apertured attachment device that includes a protruding portion, an apertured base and a tightening fastener. The protruding portion is accommodated by a corresponding aperture disposed on an end of the arm-holding structure to couple the arm-holding structure to the apertured attachment device (and thereby to the pole handle). The apertured base includes an aperture encompassed by a pair of pliable ends, wherein the tightening fastener received by a corresponding receiving hole is disposed on the pair of pliable ends to tighten and loosen the apertured attachment device around the pole-handled tool. In various embodiments, the arm holder can be constructed entirely of metal or plastic, or a combination thereof. In an embodiment, most or all of the arm holder is made of a molded thermoplastic.

DETAILED DESCRIPTION OF THE INVENTION

Figure 1:
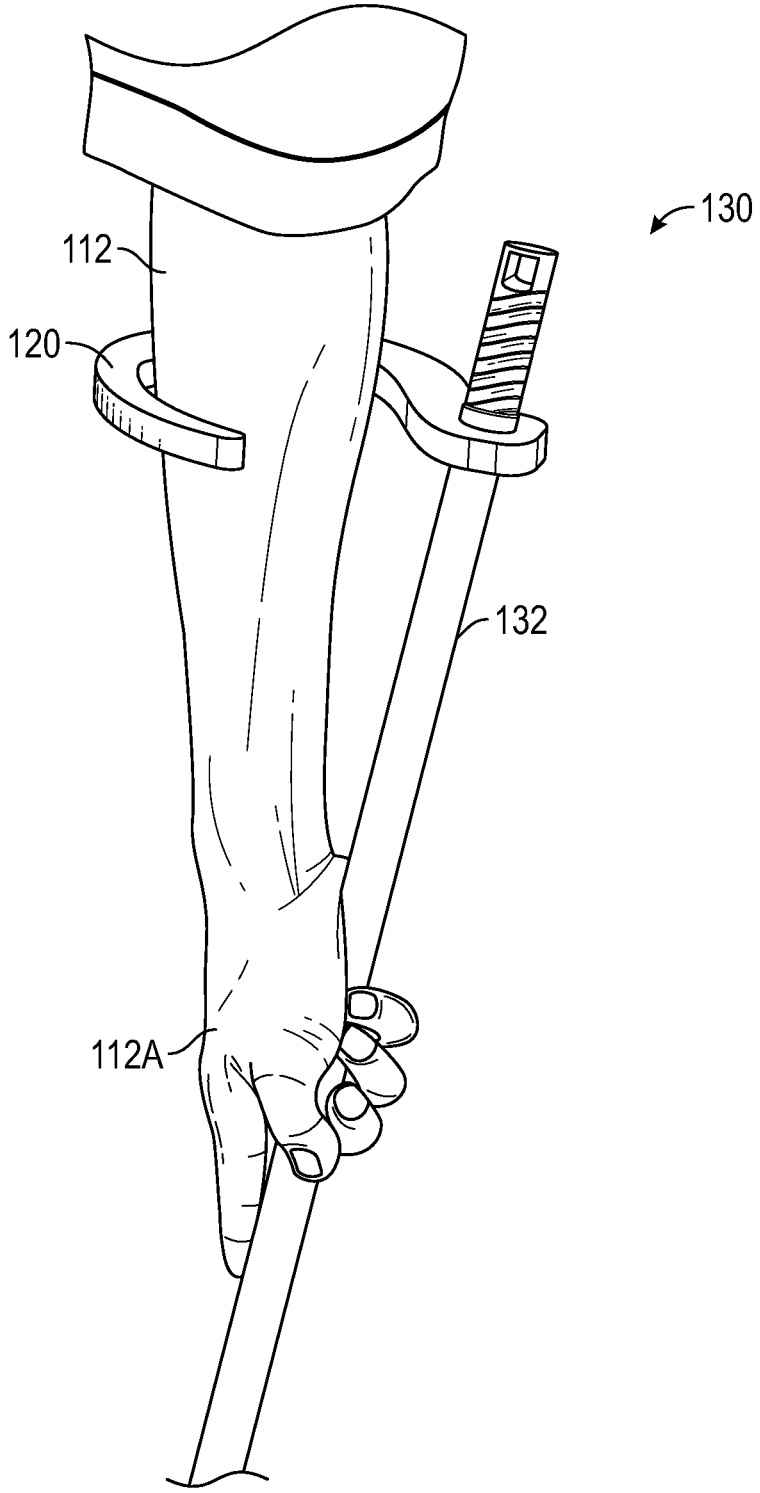
FIG. 1 illustrates an environmental view of an arm holder for a pole-handled tool, according to an embodiment.

FIG. 1 illustrates an environmental view of an arm holder 120 for a pole-handled tool 130 in use, according to an embodiment of the present invention. As illustrated, the arm holder 120 is attached to a broom. However, in other embodiments, the pole-handled tool 130 could be a mop, a rake, a squeegee, etc. As depicted, a user has a first arm 112 with a corresponding hand 112A. It is to be understood that the user also has a second arm (not shown) used for other purposes, such as holding a dustbin. The arm holder 120 can receive the user's first arm 112 which is positioned within the arm holder 120, as shown. The pole-handled tool 130 can include a pole handle 132. The pole handle 132 may be grasped by the user's hand 112A while the arm 112 presses firmly against the arm holder 120. In use, the pole handle 132 acts as a lever where the hand 112A forms a fulcrum at the grasping point.

Figure 2:
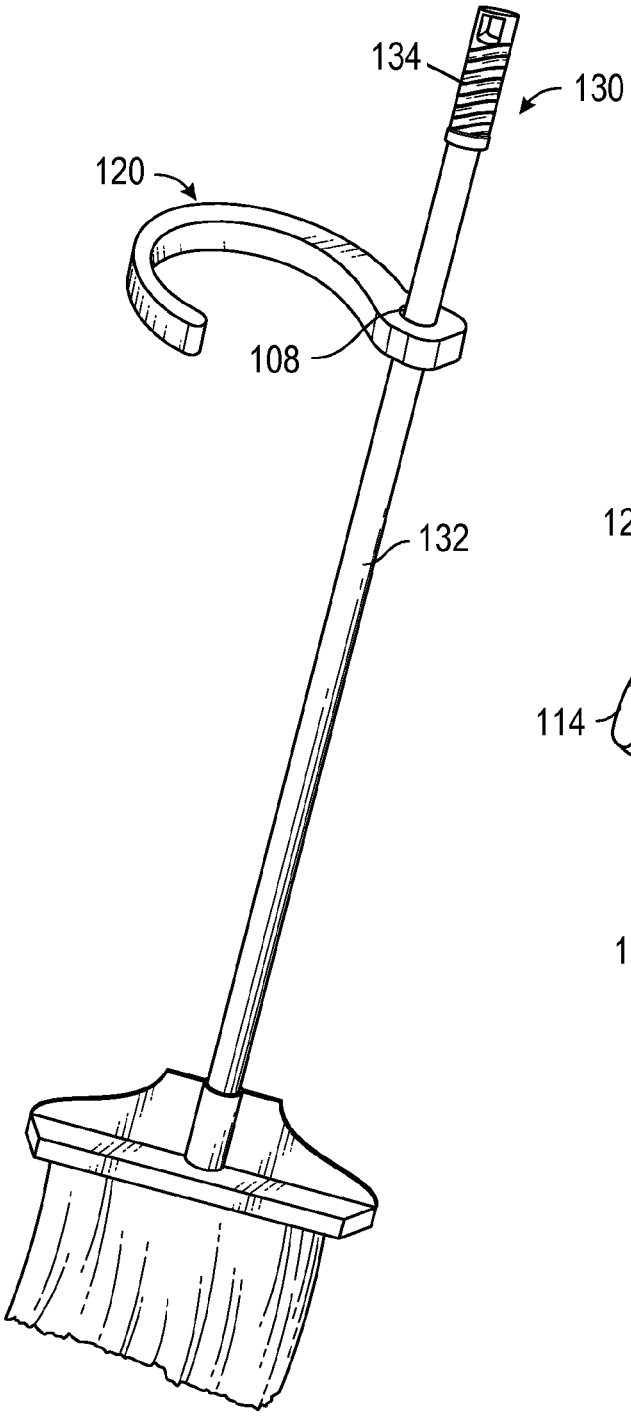
FIG. 2 illustrates another view of the arm holder of FIG. 1.

FIG. 2 illustrates another view of the arm holder 120. Attachment of the arm holder 120 to the pole-handled tool 130 may be accomplished by slipping the arm holder 120 onto the pole handle 132 below the grip 134, forming a snug friction fit. Alternatively, the arm holder 120 may be attached permanently to the pole handle 132 by use of a suitable adhesive, for example. The arm holder 120 includes a hole 108 to accommodate the arm handle 120. The arm holder 120 may be extended through the hole 108 and onto the pole handle 132. In this case, the hole 108 will have about the same or a slightly larger diameter than the pole handle 132. The arm holder 120 may be sold separately from the pole handled-tool 130. In other embodiments, the arm holder 120 and the pole-handled tool 130, such as a broom, will be sold together as one unit. In the latter case, the pole-handled tool 130 and the arm holder 120 may either be included as separate parts to be assembled by the user or assembled together as one piece at the point of manufacture.

Figure 3:
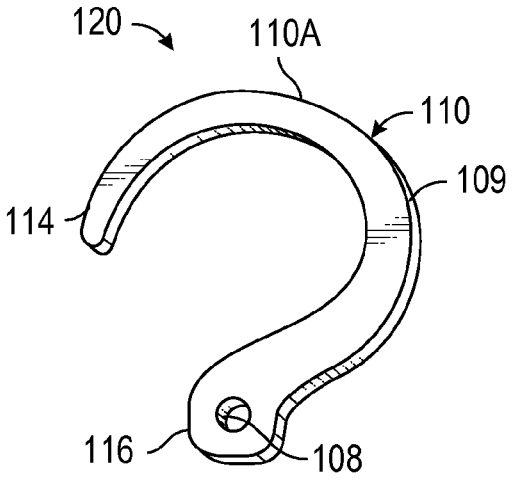
FIG. 3 illustrates the arm holder of FIG. 1 unattached.

FIG. 3 illustrates an example of the arm holder 120 unattached to the pole handle 132. As shown, the arm holder 120 includes a C-shaped portion 110 and the hole 108. The C-shaped portion 110 may receive a user's first arm 112, and may have a C-shape hook 110A or the like. The C-shaped portion 110 typically has a width that may be slightly greater around the middle of a curvature 109 of the C-shaped portion 110 than at a distal end 114 of the C-shaped portion 110 to ergonomically accommodate and fit the user's first arm 112. The C-shaped portion 110 may be approximately 3.5 inches by 4.0 inches in length to accommodate most arm dimensions, for example. In other embodiments, the C-shaped portion 110 may be a closed ring (not shown) and have an opening of any size to receive the user's first arm 112.

As mentioned, the hole 108 may accommodate the pole handle 132. Therefore, the diameter of the hole 108 depends on the diameter of the pole handle 132. The diameter of the hole 108 may be in the range of about 0.75 inch to 1.00 inch, for example. The fit between the hole 108 and the pole handle 132 may be a self-adhering relatively tight fit that still allows the first arm holder for a pole-handled tool 130 to be adjusted along the length of the pole handle 132. The arm holder 120 may be made of a suitable plastic, metal or the like. In an embodiment, the arm holder 120 is a molded thermoplastic having a thickness of about one-half inch.

Figure 4:
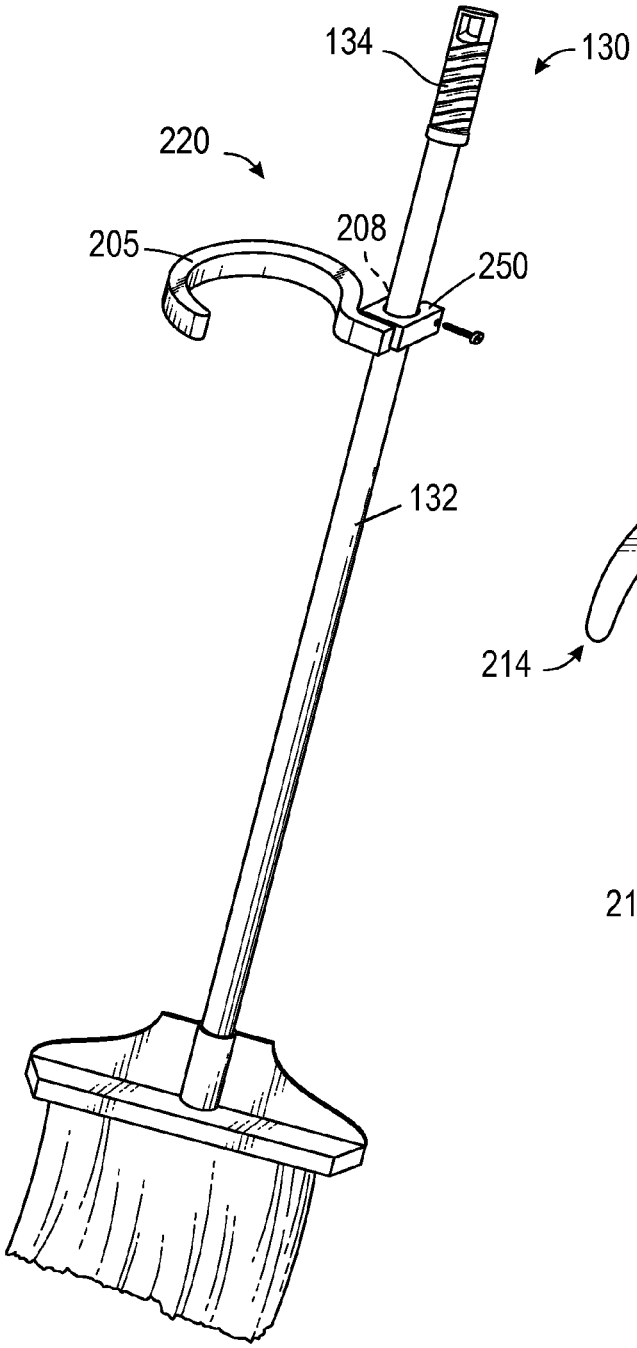
FIG. 4 illustrates a an arm holder for a pole-handled tool according to another embodiment.

FIG. 4 illustrates an arm holder 220 for a pole-handled tool 130, according to another embodiment of the present invention. As shown, the arm holder 220 includes an arm grip 205 and an attachment portion 250. The attachment portion 250 may be slipped onto the pole handle 132. In the illustrated embodiment, the pole-handled tool 130 is a broom. However, it is to be understood that the pole-handled tool 130 could be a mop, a rake, a squeegee, etc. The attachment portion 250 may include a hole 208 to accommodate the pole handle 132. The arm holder 220 may be sold separately from the pole-handled tool 130. In other embodiments, the arm holder 220 and the pole-handled tool 130, such as a broom, can be sold together as one unit.

Figure 5:
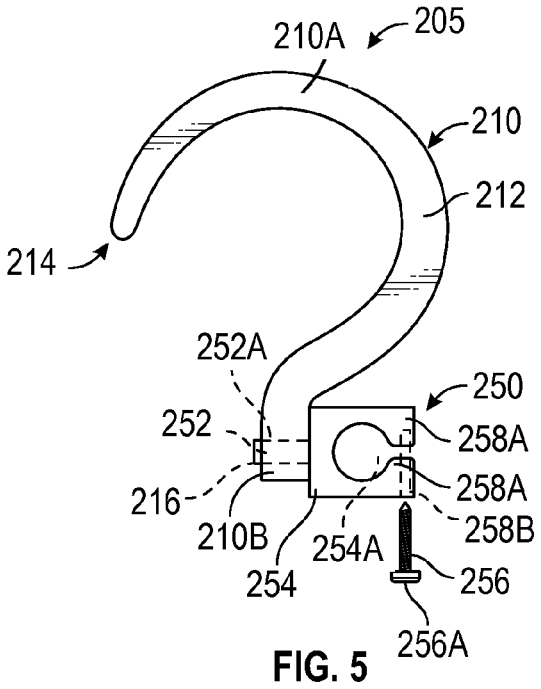
FIG. 5 illustrates a detail view of the arm holder of FIG. 4.

FIG. 5 illustrates a detail view of the arm holder 220. As mentioned, the arm holder 220 includes the arm grip 205 and the attachment portion 250. As shown, the arm grip 205 includes a C-shaped portion 210 for receiving a user's first arm, and may have a C-shape hook 210A or the like. The C-shaped portion 210 typically has a width that may be slightly greater around the middle of a curvature 212 of the C-shaped portion 210 than at a distal end 214 of the C-shaped portion 210 to ergonomically accommodate and fit the user's first arm. The C-shaped portion 210 may be approximately 3.5 inches by 4.0 inches to accommodate most users' arm dimensions. In an embodiment, the C-shaped portion 210 is about one-half inch in thickness. Alternatively, the C-shaped portion 210 may be a closed ring (not shown) and have an opening of any size to receive the user's first arm.

The attachment portion 250 is used to attach the C-shaped portion 210 to the pole handle 132. The attachment portion 250 may be an apertured attachment device including a protruding portion 252, an apertured base 254 and a tightening fastener 256. The protruding portion 252 may be accommodated by a corresponding aperture 216 that may be disposed on a second end 210B of the C-shaped portion 210 to attach the C-shaped portion 210 to the attachment portion 250 (and thereby the pole handle 132). The corresponding aperture 216 can be an unthreaded cylindrical protrusion. The apertured base 254 may include an aperture 254A that may be encompassed by a pair of pliable ends 258A. The tightening fastener 256 may be received by a corresponding receiving hole 258B disposed on the pair of pliable ends 258A to tighten and loosen the apertured attachment device 251 around the pole handle 132. More specifically, the tightening fastener 256 may be a tightening screw 256A that may be screwed to pull the pair of pliable ends 258A together to tighten the aperture 254A around the pole handle. Notably, the arm holder 220 may accommodate a left hand orientation or right hand orientation by simply flipping the arm grip 205 to the other side.

Figure 6:
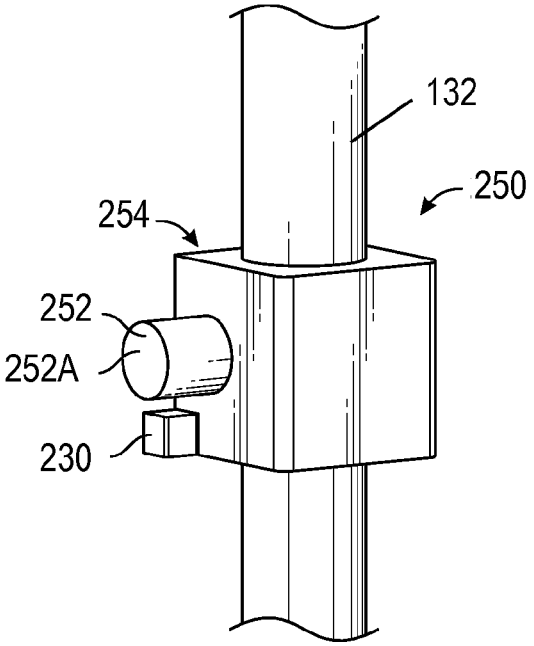
FIG. 6 illustrates a close-up perspective view of an attachment portion for attaching the arm holder of FIG. 4.

FIG. 6 illustrates a close-up perspective view of the attachment portion 250. As shown, the attachment portion 250 includes the protruding portion 252 and a stop 230. The protruding portion 252 is preferably smooth and without threads and has a distal end 252A with a substantially flat surface. The protruding portion 252 protrudes from a lateral surface of the apertured base 254 at about the center of the lateral surface. The stop 230 may be disposed adjacent to the protruding portion 252, preferably near a corner of the lateral surface and under the protruding portion 252, as shown.

Figure 7:
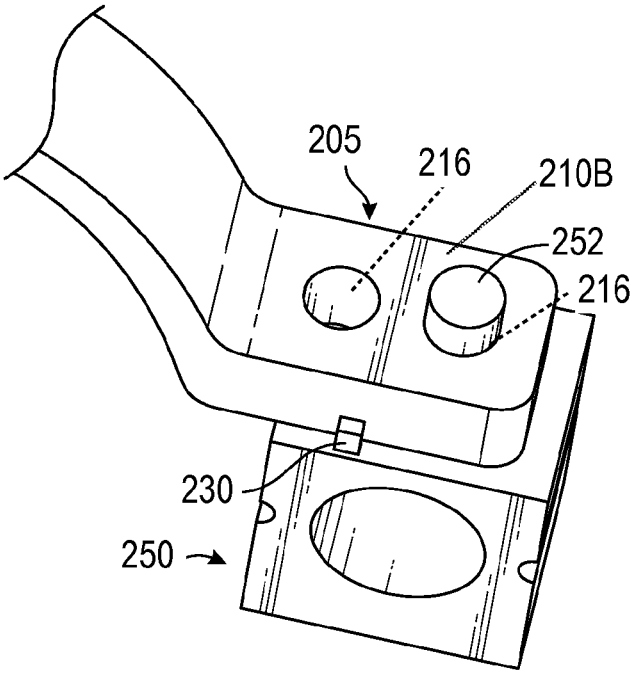
FIG. 7 illustrates a close-up view of the attachment portion.

FIG. 7 illustrates the attachment portion 250 attached to the arm grip 205. As shown, the second end 210B includes a pair of apertures (holes) 216, either of which can accommodate insertion of the protruding portion 252. Although two (2) apertures 116 are shown, it is to be understood that the number of apertures could be more than two (2), or that there could only be a single aperture 116. In operation, the user will select one of the apertures 116 for insertion of the protruding portion 252 into depending on such factors as arm size and comfort. As depicted, the right-most aperture 116 was selected allowing the arm grip 205 to be disposed more outwardly from the pole handle than had the left-most aperture 116 instead been chosen. To ensure that the arm grip 205 does not slip off, the distal end of the protruding portion 252 extends slightly (e.g., 10 mm.) through the aperture 116. The attachment of the arm grip 205 to the attachment portion 250 described herein allows rotational movement of the arm grip 205. The purpose of the stop 230 is to keep the arm grip 205 level and prevent downward rotation when the arm holder 220 is being used.

While this invention has been described in conjunction with the various exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An arm holder for a pole-handled tool, comprising:

an arm grip having a C-shaped portion; and an attachment portion for attaching the arm grip to the pole-handled tool, the attachment portion having an apertured base including a hole permitting a pole of the pole-handled tool to extend through;

wherein the arm grip is configured to pivot from a storage position to a deployed position;

wherein, in the deployed position, the arm grip is positioned substantially perpendicular to the longitudinal axis of the hole, and in the storage position, the arm grip is positioned substantially parallel to the longitudinal axis of the hole; and wherein the C-shaped portion has a gap on a lateral side permitting receipt of an arm through the gap in the deployed position such that the arm is positioned within the C-shaped portion while a corresponding hand of the arm grasps the pole permitting the pole to act as a lever where the corresponding hand forms a fulcrum.

2. The arm holder for a pole-handled tool according to claim 1, wherein the C-shaped portion has a width that is slightly greater around the middle of a curvature of the C-shaped portion than at a first end of the C-shaped portion.

3. The arm holder for a pole-handled tool according to claim 1, wherein the attachment portion further includes a protruding portion and a tightening fastener.

4. The arm holder for a pole-handled tool according to claim 3, wherein the protruding portion is accommodated by a corresponding aperture disposed on an end of the C-shaped portion to couple the apertured attachment device to the C-shaped portion.

5. The arm holder for a pole-handled tool according to claim 3, wherein the apertured base includes the hole encompassed by a pair of pliable ends.

6. The arm holder for a pole-handled tool according to claim 5, wherein the tightening fastener received by a corresponding receiving hole is disposed on the pair of pliable ends to tighten and loosen the apertured attachment device around the pole-handled tool.

7. The arm holder for a pole-handled tool according to claim 3, wherein a stop protrudes from the apertured base.

8. The arm holder for a pole-handled tool according to claim 1, wherein the arm holder for a pole-handled tool is substantially made of a molded thermoplastic.

9. The arm holder for a pole-handled tool according to claim 1, wherein the pole-handled tool is a broom.

10. A broom with an arm holder, comprising:

a broom;

an arm grip having a C-shaped portion; and an attachment portion for attaching the arm grip to the broom, the attachment portion having an apertured base including a hole permitting a pole of the broom to extend through;

wherein the arm grip is configured to pivot from a storage position to a deployed position;

wherein, in the deployed position, the arm grip is positioned substantially perpendicular to the longitudinal axis of the hole, and in the storage position, the arm grip is positioned substantially parallel to the longitudinal axis of the hole; and wherein the C-shaped portion has a gap on a lateral side permitting receipt of an arm through the gap in the deployed position such that the arm is positioned within the C-shaped portion while a corresponding hand of the arm grasps the pole, permitting the pole to act as a lever where the corresponding hand forms a fulcrum.

11. The broom with an arm holder according to claim 10, wherein the C-shaped portion has a width that is slightly greater around the middle of a curvature of the C-shaped portion than at a first end of the C-shaped portion.

12. The broom with an arm holder according to claim 10, wherein the arm holder is substantially made of a molded thermoplastic.

* * * * *